US009788643B2

(12) United States Patent
Ji

(10) Patent No.: US 9,788,643 B2
(45) Date of Patent: Oct. 17, 2017

(54) TOOTHBRUSH

(75) Inventor: Yan Mei Ji, JiangSu (CN)

(73) Assignee: COLGATE-PALMOLIVE COMPANY, New York, NY (US)

( * ) Notice: Subject to any disclaimer, the term of this patent is extended or adjusted under 35 U.S.C. 154(b) by 160 days.

(21) Appl. No.: 14/344,868

(22) PCT Filed: Sep. 14, 2011

(86) PCT No.: PCT/CN2011/001555
§ 371 (c)(1),
(2), (4) Date: Apr. 10, 2014

(87) PCT Pub. No.: WO2013/037085
PCT Pub. Date: Mar. 21, 2013

(65) Prior Publication Data

US 2014/0338140 A1 Nov. 20, 2014

(51) Int. Cl.

| | |
|---|---|
| ***A46B 9/04*** | (2006.01) |
| ***A46B 3/00*** | (2006.01) |
| ***A46D 1/00*** | (2006.01) |
| ***A46B 9/02*** | (2006.01) |

(52) U.S. Cl.
CPC ..... *A46B 9/04* (2013.01); *A46B 3/00* (2013.01); *A46B 9/028* (2013.01); *A46D 1/0276* (2013.01); *A46B 2200/1066* (2013.01)

(58) Field of Classification Search
CPC ..... A46B 9/04
USPC ..... 15/167.1
See application file for complete search history.

(56) References Cited

U.S. PATENT DOCUMENTS

| | | | | |
|---|---|---|---|---|
| 4,033,008 A | | 7/1977 | Warren et al. | |
| 5,257,434 A | * | 11/1993 | Nabetani | A46B 9/04 15/167.1 |
| 5,533,227 A | | 7/1996 | Ito et al. | |
| 5,535,474 A | | 7/1996 | Salazar | |

(Continued)

FOREIGN PATENT DOCUMENTS

| | | |
|---|---|---|
| CN | 1084722 | 4/1994 |
| CN | 2194644 | 4/1995 |

(Continued)

OTHER PUBLICATIONS

International Search Report and the Written Opinion issued in International Application PCT/CN2011/001555 mailed May 31, 2012.

*Primary Examiner* — Mark Spisich

(57) ABSTRACT

The present invention is directed to a toothbrush (100) that incorporates tapered bristle filaments (141) in combination with tuft holes (142) of a reduced size, such as between 1.3 mm to 1.4 mm in diameter. In another aspect, the invention provides a toothbrush (100) that balances the number of tuft holes (142) and the number (X) of tapered bristle filaments (141) within each tuft hole (142) to achieve a unique ratio that reduces the cost of manufacture of the toothbrush (100) while maintaining a mouth-feel that consumers associate with a quality product. In still another aspect, the present invention provides a toothbrush (100) that incorporates tapered bristle filaments (141) and also achieves a balance between the perimeter of reduced size tuft holes (142) and the spacing between adjacent tuft holes (142) to achieve a unique ratio that reduces the cost of manufacture of the toothbrush (100) while maintaining a mouth-feel that consumers associate with a quality product.

7 Claims, 5 Drawing Sheets

(56) References Cited

U.S. PATENT DOCUMENTS

| | | | | |
|---|---|---|---|---|
| 5,850,660 | A | 12/1998 | O'Halloran | |
| 6,021,538 | A | 2/2000 | Kressner et al. | |
| 6,314,605 | B1 | 11/2001 | Solanki et al. | |
| 6,405,401 | B1 | 6/2002 | Hellerud et al. | |
| 2004/0107521 | A1 | 6/2004 | Chan et al. | |
| 2006/0096053 | A1* | 5/2006 | Fischer | A46D 1/0284 15/167.1 |
| 2007/0271717 | A1 | 11/2007 | Clos et al. | |
| 2010/0263148 | A1 | 10/2010 | Jimenez et al. | |
| 2010/0275397 | A1 | 11/2010 | Moskovich et al. | |
| 2011/0030160 | A1 | 2/2011 | Knutzen et al. | |

FOREIGN PATENT DOCUMENTS

| | | | |
|---|---|---|---|
| CN | 1813611 | | 8/2006 |
| CN | 101010018 | | 8/2007 |
| EP | 290873 | * | 11/1988 |
| EP | 596633 | * | 5/1994 |
| GB | 705725 | * | 3/1954 |
| JP | 10-234472 | * | 9/1998 |
| JP | 10-313946 | * | 12/1998 |
| JP | 2002-345556 | * | 12/2002 |
| JP | 2003189940 | | 7/2003 |
| JP | 2004-73730 | * | 3/2004 |
| JP | 2004-089470 | | 3/2004 |
| JP | 2005-177063 | * | 7/2005 |
| JP | 2007-295979 | | 11/2007 |
| JP | 2008-36098 | * | 2/2008 |
| JP | 2008-154808 | | 7/2008 |
| JP | 2009-066050 | | 4/2009 |
| JP | 2011-24839 | * | 2/2011 |
| KR | 0666455 | | 1/2007 |
| WO | WO 2005/087045 | | 9/2005 |
| WO | WO 2006/018927 | | 2/2006 |

* cited by examiner

TOOTHBRUSH

CROSS-REFERENCE TO RELATED PATENT APPLICATIONS

The present application is a U.S. national stage entry under 35 U.S.C. §371 of Patent Cooperation Treaty Patent Application No. PCT/CN2011/001555, filed Sep. 14, 2011, the entirety of which is incorporated herein by reference.

FIELD OF THE INVENTION

The present invention relates generally to toothbrushes, and specifically to toothbrushes having bristle tufts formed by tapered bristle filaments.

BACKGROUND OF THE INVENTION

Toothbrushes using tapered bristle filaments (also referred to as tapered bristles or needle bristles) are known in the art. Tapered bristle filaments are bristle filaments in which at least the tip portions (i.e., the terminal end portions) of the bristle filaments have a tapered cross-section. The base portions of the tapered bristle filaments may have a generally cylindrical shape or may also have a tapered cross-section as desired.

The use of tapered bristle filaments in toothbrushes has become increasingly popular due at least in part to the unique "mouth-feel" and excellent cleaning performance provided by the very fine tapered tip portions. However, tapered bristle filaments require additional processing steps as compared to traditional non-tapered bristle filaments. Thus, tapered bristle filaments are quite a bit more expensive than non-tapered bristle filaments.

Therefore, there is a need for a toothbrush design that helps offset the increased cost of using tapered bristle filaments while maintaining its cleaning efficacy, unique mouth-feel, and perception of a quality product to the consumer.

BRIEF SUMMARY OF THE INVENTION

The present invention, in one aspect, provides a toothbrush that incorporates tapered bristle filaments in combination with tuft holes of a reduced size. In another aspect, the invention provides a toothbrush that balances the number of tuft holes and the number of tapered bristle filaments within each tuft hole to achieve a unique ratio that reduces the cost of manufacture of the toothbrush while maintaining a mouth-feel that consumers associate with a quality product. In still another aspect, the present invention provides a toothbrush that incorporates tapered bristle filaments and also achieves a balance between the diameter of reduced size tuft holes and the spacing between adjacent tuft holes to achieve a unique ratio that reduces the cost of manufacture of the toothbrush while maintaining a mouth-feel that consumers associate with a quality product.

In one embodiment, the present invention is directed to a toothbrush comprising: a handle; a head having a first surface comprising a plurality of tuft holes having a diameter $D_{TH}$, wherein $D_{TH}$ is in a range of 1.3 mm to 1.4 mm; and a bristle tuft mounted within and extending from each of the tuft holes, each of the bristle tufts formed by a plurality of tapered bristle filaments.

In another embodiment, the present invention is directed to a toothbrush comprising: a handle; a head having a first surface having X number of tuft holes; a bristle tuft mounted within and extending from each of the tuft holes, each of the bristle tufts formed by Y number of tapered bristle filaments; and wherein a ratio of X to Y is in a range between 1.05 to 1.64.

In yet another embodiment, the present invention is directed to a toothbrush comprising: a handle; a head having a first surface having a row of tuft holes, each of the tuft holes having a perimeter P; a bristle tuft mounted within and extending from each of the tuft holes, each of the bristle tufts formed by a plurality of tapered bristle filaments; wherein adjacent tuft holes in the row of tuft holes are separated by a distance Z, wherein Z is a linear distance between center points of the adjacent tuft holes; and wherein a ratio of Z to P is in a range of 0.35 to 0.46.

In an even further aspect, the invention can be a toothbrush comprising: a handle; a head having a first surface and a second surface, the first surface comprising a tufting area $A_{TS}$ comprising X number of tuft holes, each of the tuft holes having a tuft hole area $A_{TH}$; a bristle tuft mounted within and extending from each of the tuft holes, each of the bristle tufts formed by a plurality of tapered bristle filaments; and wherein a ratio of $A_{TS}$ to $X \times A_{TH}$ is in a range of 3.4 to 4.4.

In a still further aspect, the invention can be a toothbrush comprising: a handle; a head having a first surface and a second surface, the first surface comprising a tufting area $A_{TS}$ comprising X number of tuft holes; a bristle tuft mounted within and extending from each of the tuft holes, each of the bristle tufts formed by a plurality of tapered bristle filaments; and wherein a ratio of $A_{TS}$ to X is in a range of 5.0 to 6.5.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1:
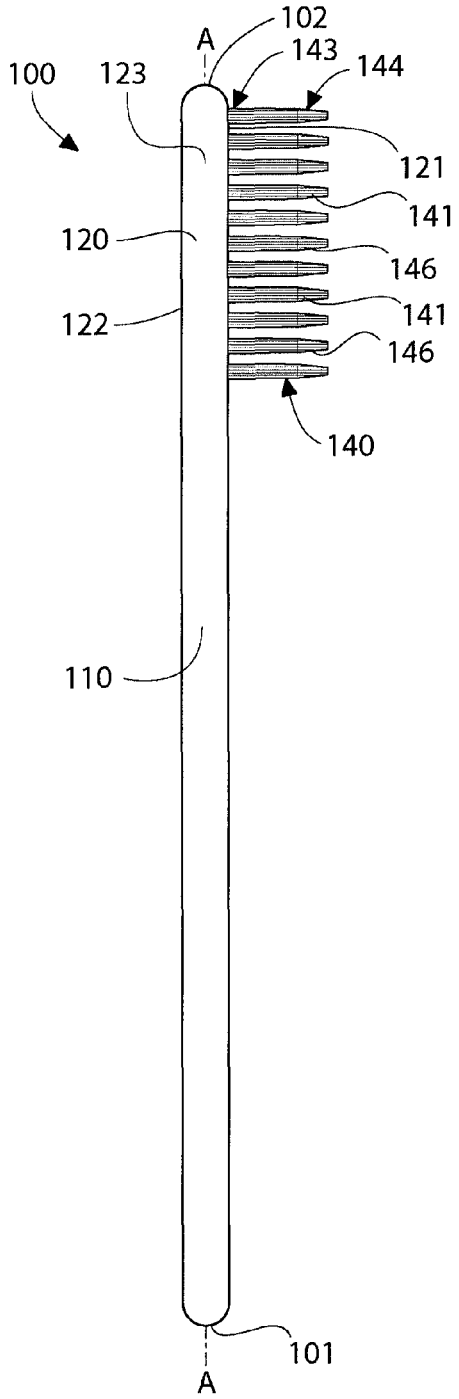
FIG. 1 is a side planar view of a toothbrush according to an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention.

Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Referring to FIG. 1, a toothbrush 100 is illustrated. The toothbrush 100 extends from a proximal end 101 to a distal end 102 along a longitudinal axis A-A. The toothbrush 100 comprises a handle 110 and a head 120. The handle 110 is an elongated structure that provides a user of the toothbrush 100 with a mechanism by which he/she can readily grip and manipulate the toothbrush 100. The handle 110 may be formed of many different shapes, sizes, materials and by a variety of manufacturing methods that are well-known to those skilled in the art. If desired, the handle 110 may include a suitable textured grip made of a soft elastomeric material to enhance the handling of the toothbrush 100. Although not illustrated, in certain embodiments the handle 110 may transition into a neck, which may be a portion of the toothbrush 100 with a smaller transverse cross-sectional area than the handle 110. However, in other embodiments the handle 110 may transition directly into the head 120.

In the exemplified embodiment, the toothbrush 100 is illustrated as a manual toothbrush. However, the invention is not to be so limited and in certain other embodiments the toothbrush can be a powered or electric toothbrush.

The handle 110 and the head 120 of the toothbrush 100 are formed as a single unitary structure using a molding, milling, machining or other suitable process. However, in other embodiments, the handle 110 and the head 120 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Whether the head 120 and handle 110 are of a unitary or multi-piece construction (including connection techniques) is not limiting of the present invention, unless specifically stated. In some embodiments of the invention, the head 120 may be detachable (and replaceable) from the handle 110 using techniques known in the art.

The head 120 generally comprises a front surface 121, a rear surface 122 opposite the front surface 121 and a peripheral side surface 123 that extends between the front and rear surfaces 121, 122. The front surface 121 and the rear surface 122 of the head 120 can take on a wide variety of shapes and contours, none of which are limiting of the present invention. For example, the front and rear surfaces 121, 122 can be planar, contoured or combinations thereof. Moreover, if desired, the rear surface 122 may also comprise additional structures for oral cleaning or tooth engagement, such as a soft tissue cleaner or a tooth polishing structure. An example of a soft tissue cleaner is an elastomeric pad comprising a plurality of nubs and/or ridges. An example of a tooth polishing structure can be an elastomeric element, such as a prophy cup(s) or elastomeric wipers. Furthermore, while the head 120 is normally widened relative to the handle 110 (and the neck where applicable), it could in some constructions simply be a continuous extension or narrowing of the handle 110.

Figure 2:
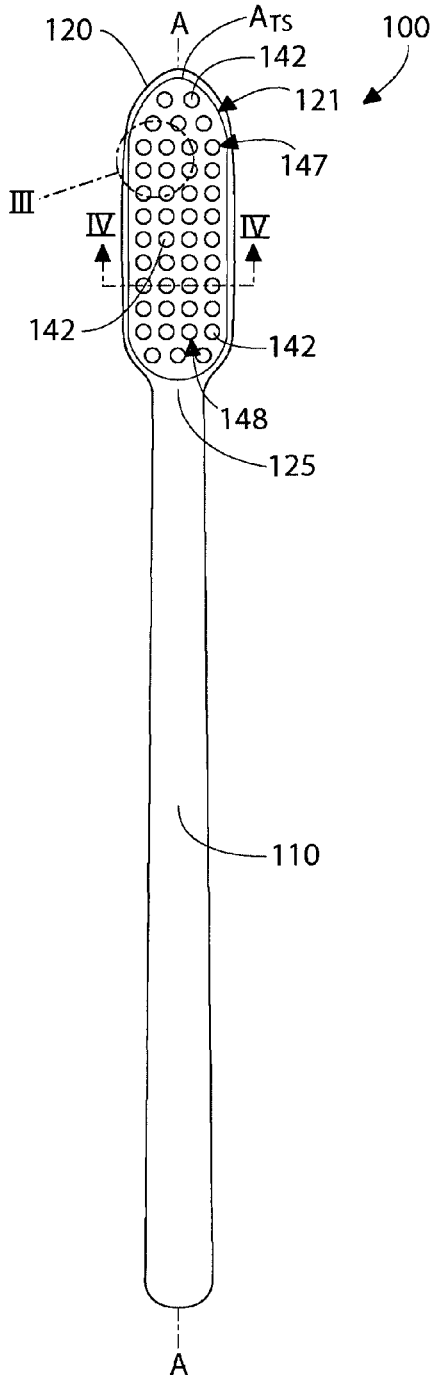
FIG. 2 is a front planar view of the toothbrush of FIG. 1.

Referring to FIGS. 1 and 2 concurrently, the front surface 121 of the head 120 comprises a bristle field 140, extending therefrom for cleaning teeth. While the bristle field 140 is particularly suited for brushing teeth, the bristle field 140 can also be used to clean other oral surfaces as desired. The bristle field 140 comprises a plurality of bristle tufts 146, which in turn comprises a plurality of tapered bristle filaments 141, mounted within tuft holes 142 of the head 120 and extend from the front surface 121 of the head 120.

The front surface 121 of the head 120 of the toothbrush 100 comprises a tufting area $A_{TS}$ in which a plurality of the tuft holes 142 are provided. In one embodiment, the tufting area $A_{TS}$ is a substantially planar surface that is delimited by a contoured peripheral edge of the head 120. In other embodiments, the tufting area $A_{TS}$ may comprise one or more contours, either concave and/or convex. In the exemplified embodiment, the tufting area $A_{TS}$ is oval in shape but can take on other shapes if desired. In certain embodiments, the tufting area $A_{TS}$ is in a range of 180 to 270 $mm^2$. In one preferred embodiment where the toothbrush 100 has a large head 120, the tufting area $A_{TS}$ is in a range of 210 $mm^2$ to 270 $mm^2$ in size. In a further preferred embodiment having a large head 120, the tufting area $A_{TS}$ is in a range of 230 $mm^2$ to 250 $mm^2$, with a size of approximately 242 $mm^2$ being most preferred. In one preferred embodiment where the toothbrush 100 has a small head 120, the tufting area $A_{TS}$ is in a range of 180 $mm^2$ to 210 $mm^2$ in size. In a further preferred embodiment having a small head 120, the tufting area $A_{TS}$ is in a range of 190 $mm^2$ to 200 $mm^2$, with a size of approximately 195 $mm^2$ being most preferred.

The tufting area $A_{TS}$ of the front surface 121 of the head 120 comprises X number of the tuft holes 142. In the exemplified embodiment, the number X of tuft holes 142 on the head 120 is equal to 44. However, the invention is not to be so limited and the number X of tuft holes 142 in the front surface 121 of the head 120 can range from 36 to 44 in other embodiments. More specifically, in an embodiment where the toothbrush 100 has a large head 120, X is equal to approximately 44 and in an embodiment where the toothbrush 100 has a small head 120, X is equal to approximately 36. Each of the tuft holes 142 comprises a diameter $D_{TH}$ that is in a range of 1.3 mm to 1.4 mm.

In one embodiment, the diameter $D_{TH}$ is selected so each tuft hole 142 has a tuft hole area $A_{TH1}$ in a range of 1.30 $mm^2$ to 1.55 $mm^2$. In certain other embodiments, the tuft hole area $A_{TH1}$ and the number X of the tuft holes 142 are selected so that the ratio of $A_{TS}$ to $X \times A_{TH1}$ is in a range of 3.4 to 4.4, and most preferably in a range of 3.52 to 3.57. As used herein, all ratios are given as an empirical number and, thus, are given with respect to 1. For example a ratio of 2 is, in fact, a ratio of 2:1.

Furthermore, a ratio of the tufting area $A_{TS}$ to the number of holes X is in a range of 5.2 to 6.4. In one preferred embodiment wherein the tuft holes 142 have a circular or rounded shape, the ratio of the tufting area $A_{TS}$ to the number of holes X is in a range of 5.3 to 5.6, and more particularly in a range of approximately 5.4 to 5.5.

The tuft holes 142 are arranged on the front surface 121 of the head 120 in rows. The rows of the tuft holes 142 include transverse rows 147 that extend substantially perpendicular to the longitudinal axis A-A and longitudinal rows 148 that extend substantially parallel to the longitudinal axis A-A. However, a number of the tuft holes 142 that are positioned nearest to the distal end 102 of the head 120 and a number of the tuft holes 142 that are positioned nearest a proximal end 125 of the head 120 are not in longitudinal alignment with the longitudinal rows 148 located in a central area of the head 120. Furthermore, although the exemplary embodiment includes a plurality of transverse rows 147 and a plurality of longitudinal rows 148, in certain embodiments, only a single transverse row 147 and/or longitudinal row 148 may be utilized. Similarly, in certain embodiments, the tuft holes 142 that are positioned nearest to the distal end 102 of the head 120 and the tuft holes 142 that are positioned nearest a proximal end 125 may be in longitudinal alignment with the longitudinal rows 148 located in a central area of the head 120.

In the exemplified embodiment, a central section of the tuft holes 142 are arranged on the front surface 121 of the head 120 in a 9×4 array. Furthermore, there is an additional transverse row of three tuft holes 142 positioned below the 9×4 array nearest the proximal end of the head 120, an additional transverse row of three tuft holes 142 positioned above the 9×4 array and an additional transverse row of two tuft holes 142 positioned at the distal end 102 of the head 120. Of course, the invention is not to be limited by the particular arrangement of the tuft holes 142 illustrated and other arrangements of the tuft holes 142 on the front surface 121 of the head 120 are contemplated within the scope of the present invention.

Figure 4:
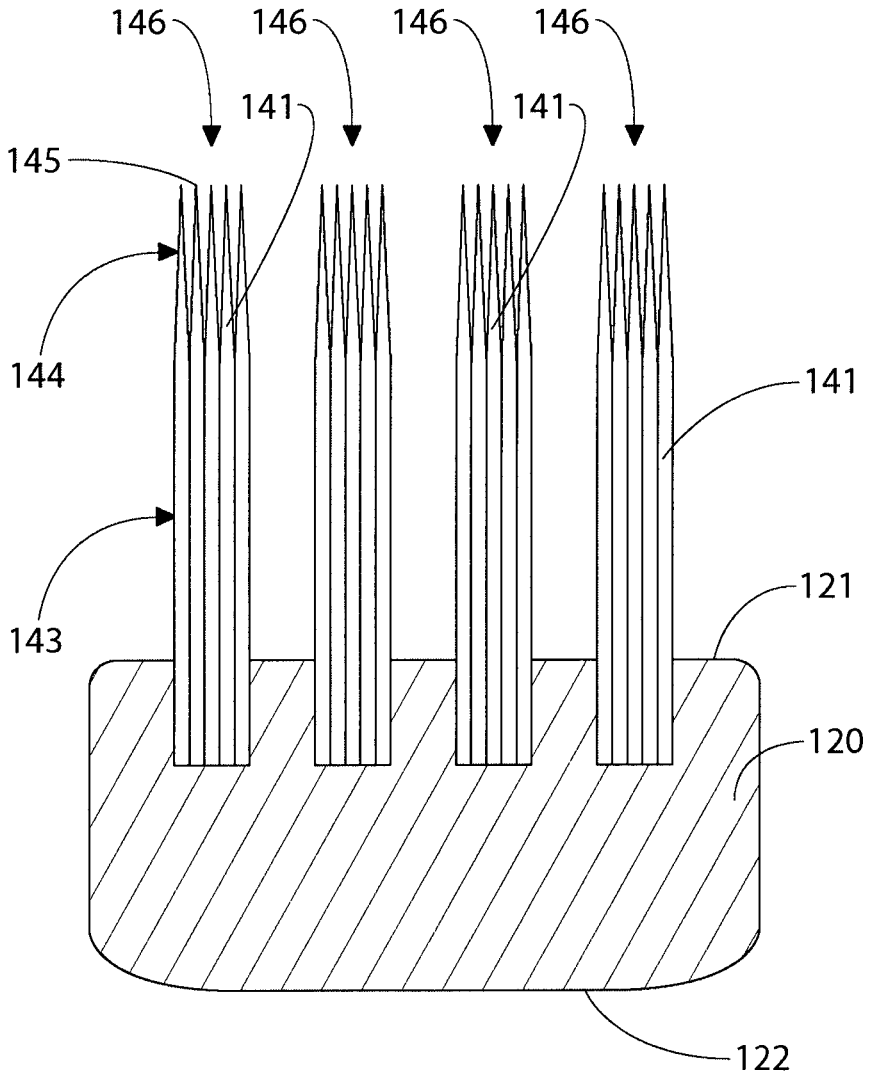
FIG. 4 is a longitudinal cross-sectional view taken along line IV-IV of FIG. 2.

Referring to FIGS. 1 and 4 concurrently, the tapered bristle filaments 141 will be described in more detail. Each of the tapered bristle filaments 141 comprises a base portion 143 and a tapered portion 144. Furthermore, each of the tapered bristle filaments 141 can be formed of a wide variety of materials suitable for forming filaments for oral use, including without limitation, polybutylene terephthalate, polyethylene terephthalate, nylon or the like. The tapered portions 144 of the tapered bristle filaments 141 can be formed by means of chemical etching by applying, for example, sulfuric acid or sodium hydroxide solution to the tapered portion 144 of the tapered bristle filaments 141 via an immersion or spray technique. During such a process, the chemical erodes away portions of the tapered bristle filaments 141 to form the tapered portion 144. Alternatively, the tapered portions 144 of the tapered bristle filaments 141 may be tapered by mechanical means, including shaving the bristle ends with the blade of a knife, grinding, or with a rounding machine or by any other means. Whether chemical or mechanical means are used to form the desired taper, the tapering results in a bristle having a generally conical or truncated-cone profile that tapers towards its terminal end.

In the exemplified embodiment, the cylindrical base portion 143 of each of the tapered bristle filaments 141 extends approximately two-thirds the length of the tapered bristle filament 141 from the front surface 121 of the head 120 to a distal tip 145 of the tapered bristle filament 141. Thus, in the exemplified embodiment each of the tapered bristle filaments 141 tapers to the distal tip 145 only in the top one-third portion of the tapered bristle filament 141. However, in certain other embodiments the tapered portion 144 of the tapered bristle filament 141 may extend from approximately one-half of the length of the tapered bristle filament 141 from the front surface 121 of the head 120 to the distal tip 145 of the tapered bristle filament 141. In such an embodiment, the tapered bristle filaments 141 begin to taper at approximately one-half the length. Furthermore, in still other embodiments each of the tapered bristle filaments 141 may taper throughout the entire length of the filament 141 including both the base and tapered portions 143, 144. In still other embodiments, the tapered portion 144 may be less than one-third of the entire length of the filament 141. Thus, the invention is not to be limited by the relative length the base portion 143 and the tapered portion 144.

Figure 3:
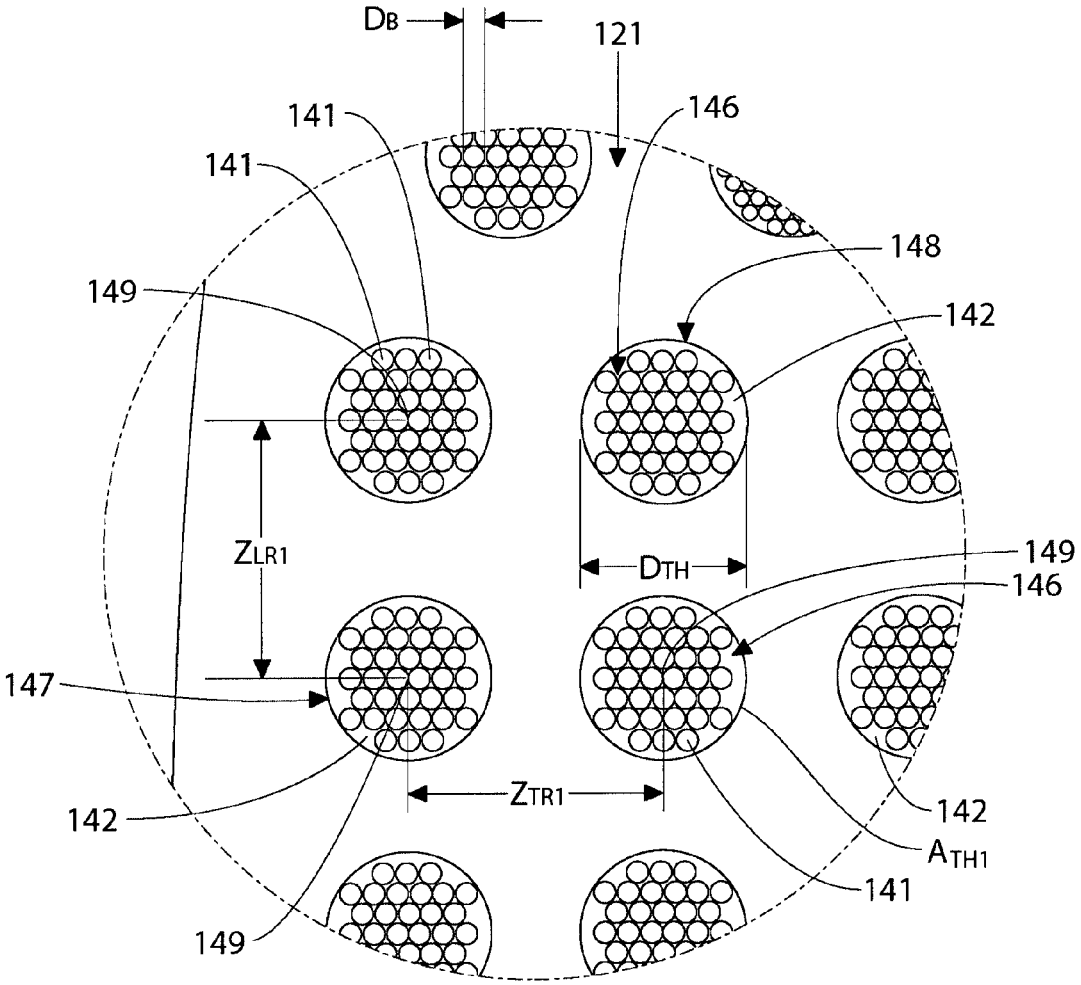
FIG. 3 is a close-up view of area III of FIG. 2.

Each of the tapered bristle filaments 141 has a diameter DB (referring to FIG. 3) at the base portion 143 that is in a range of 0.16 mm to 0.19 mm. The diameter DB is the largest diameter of the tapered bristle filaments 141. Thus, as the bristle filaments 141 taper towards the distal end 145, the diameter of the tapered bristle filaments 141 decreases.

The bristle tufts 146 of the bristle field 140 of the present invention can be affixed to the head 120 in any manner known in the art. For example, staples/anchors, in-mold tufting (IMT) or anchor free tufting (AFT) could be used to mount the bristle tufts 146 (which comprise the tapered bristle filaments 141) to the head 120. In AFT, a plate or membrane is secured to the brush head, such as by ultrasonic welding. The bristles extend through the plate or membrane. The tapered free ends of the tapered bristle filaments 141 on one side of the plate or membrane perform the cleaning function. The non-tapered free ends of the tapered bristle filaments 141 on the other side of the plate or membrane are melted together by heat to be anchored in place. Alternatively, the bristles could be mounted to tuft blocks or sections by extending through suitable openings in the tuft blocks so that the base of the bristles is mounted within or below the tuft block.

The term "bristle filament" is used herein to refer to each individual filament that extends upwardly from the front surface 121 of the head 120. When the bristle tufts 146 are connected to the head via a traditional staple/anchor technique, the bristle tufts 146 (and thus each bristle strand that makes up the bristle tuft 146) are mounted within the tuft holes 142 in a bent manner so as to resemble a general U-shape. Thus, each single bristle strand (which is tapered at both ends) is bent in a U-shape and, as a result, forms two distinct tapered bristle filaments 141 extending upwardly from the front surface 121 of the head 120. In other words, when using staples/anchors, a single bristle strand is bent in half and stapled to the head 121 such that two tapered bristle filaments 141 extend from the head 120. Thus, the number of tapered bristle filaments 141 is twice the number of bristle strands. In order to ensure that each of the bristle filaments 141 has a taper at its distal end 145, when anchors/staples are used to connect the tapered bristle filaments 141 to the head 120, the bristle strands are tapered at both ends such that each end of the bristle strand is tapered. In this manner, each of the two bristle filaments 141 that extend from the head 120 as a result of a single bristle strand being affixed to the head 120 via anchors/staples will have a taper.

When using IMT of AFT for connecting the tooth engaging elements 140 to the head 120, each individual bristle strand results in only a single tapered bristle filament 141. Thus, in such an embodiment, each of the tapered bristle filaments 141 is tapered on only one end. Furthermore, in such embodiments the number of tapered bristle filaments actually extending from the front surface 121 of the head 120 is equal to the number of bristle strands actually affixed to the head 120.

Referring to FIGS. 1-4 concurrently, the toothbrush 100 of the present invention will be described in more detail.

Mounted within each of the tuft holes 142 is a bristle tuft 146. Each of the bristle tufts 146 is formed from a plurality of the tapered bristle filaments 141. More specifically, each of the bristle tufts 146 comprises a number Y of tapered bristle filaments 141. In the exemplified embodiment, each of the bristle tufts 146 comprises 34 of the tapered bristle filaments 141 (which, as described above, would be equal to 17 bristle strands when an anchor/staple technique is utilized). However, the invention is not to be so limited and the number Y of tapered bristle filaments 141 that form each bristle tuft 146 can be in a range from 28 to 40 (which would be equivalent to 14 to 20 bristle strands when an anchor/staple technique is used). Thus, the total number of tapered bristle filaments 141 on the toothbrush 100 is in a range from 1176 to 1840, and more specifically in a range from 1232 to 1760. When the tapered bristle filaments 141 are connected to the head via an IMT of AFT technique, the total number of bristle strands is equal to the total number of tapered bristle filaments 141. However, when the tapered bristle filaments 141 are connected to the head via an anchor/staple technique such that a single bristle strand creates two distinct tapered bristle filaments 141, the toothbrush 100 will comprise from 588 to 920 total bristle strands, and more specifically from 616 to 880 total bristle strands.

Furthermore, as discussed above, the tuft holes 142 are arranged on the first surface 121 of the head 120 in rows 147, 148. Adjacent tuft holes 142 in each of the transverse rows 147 are separated by a distance $Z_{TR1}$. More specifically, each of the tuft holes 142 has a center point 149 and $Z_{TR1}$ is a linear distance between the center points 149 of adjacent tuft holes 142 in the transverse rows 147. Furthermore, adjacent tuft holes 142 in each of the longitudinal rows 148 are separated by a distance $Z_{LR1}$. More specifically, $Z_{LR1}$ is a linear distance between the center points 149 of adjacent tuft holes 142 in the longitudinal rows 148. In the exemplified embodiment, the distance $Z_{TR1}$ is equal to the distance $Z_{LR1}$. However, in certain other embodiments the distance $Z_{TR1}$ can be different than the distance $Z_{LR1}$. In embodiments where $Z_{TR1}$ and $Z_{LR1}$ are different, $Z_{LR1}$ is greater than $Z_{TR1}$. Regardless of whether the distances $Z_{TR1}$, $Z_{LR1}$ are equal or different, both the distance $Z_{TR1}$ between adjacent tuft holes 142 in each of the transverse rows 147 and the distance $Z_{LR1}$ between adjacent tuft holes 142 in each of the longitudinal rows are in a range of 2.1 mm to 2.4 mm. In one specific embodiment, the distance $Z_{TR1}$ is in a range of 2.1 mm to 2.3 mm, with 2.2 mm being preferred, while the distance $Z_{LR1}$ is in a range of 2.3 mm to 2.4 mm, with 2.32 mm being preferred. In another embodiment, the distance $Z_{LR1}$ is preferably 2.3 mm. The tuft holes 142 also have a perimeter (or circumference) that is in a range of between 4.0 mm to 5.0 mm.

When circular tufts holes 142 are used, with the distance Z being in the range of 2.1 mm to 2.4 mm and the diameter $D_{TH}$ of the tuft holes 142 being in the range of 1.3 mm to 1.4 mm, a ratio of Z to $D_{TH}$ is preferably maintained in a range of 1.5 to 1.8.

Furthermore, as described above the number X of tuft holes 142 is in a range of 42 to 46 and the number Y of tapered bristle filaments 141 per tuft hole 142 is in a range of 28 to 40. Thus, a ratio of X to Y is in a range of 1.05 to 1.64, and more specifically the ratio of X to Y is approximately equal to 1.3. However, the invention is not to be so limited and the ratio of X to Y may fall outside of the above-noted range in certain embodiments. Nonetheless, the ratio of X to Y is greater than one in all embodiments.

The present invention uses the tuft holes 142 having a diameter $D_{TH}$ in a range of 1.3 mm to 1.4 mm to increase the total number of the tuft holes 142 that will fit on the head by creating a pattern of the tuft holes 142 with a relatively small linear distance between the center points 149 of adjacent tuft holes 142. By positioning the tuft holes 142 closely together on the head 110, a reduction in the number of tapered bristle filaments 141 disposed within each tuft hole 142 can be achieved without reducing the overall appearance or affect of the toothbrush 100. Table 1 provides a relative comparison between a conventional tuft hole layout and the tuft hole layout of the present invention.

TABLE 1

| | Hole Diameter | Bristle Diameter | Filaments per hole | Number of Tuft Holes | Total Number of Filaments |
|---|---|---|---|---|---|
| Conventional | 1.52 mm | 0.175 mm | 46-50 | 40 | 1840-2000 |
| Present Invention | 1.40 mm | 0.175 mm | 28-40 | 44 | 1232-1760 |

The data in Table 1 indicates an average strand reduction from 1920 in a conventional tuft layout, versus 1496 for the layout of the present invention described herein above, despite the increase in the number of tuft holes on the head. This represents a surprising 22% reduction in the amount of tapered bristle filaments on average per toothbrush. Such a reduction in the total number of tapered bristle filaments per toothbrush is significant due to the added costs involved in creating a tapered bristle filament. In addition, such a reduction in the amount of tapered bristle filaments provides improved deeper cleaning because less bristle filaments are fighting for the tight and hard-to-reach spaces between gums and teeth. Further, it is believed that the reduction in the amount of tapered bristle filaments leads to less waste of materials while maintaining similar performance, and in some instances achieving superior performance.

Figure 5:
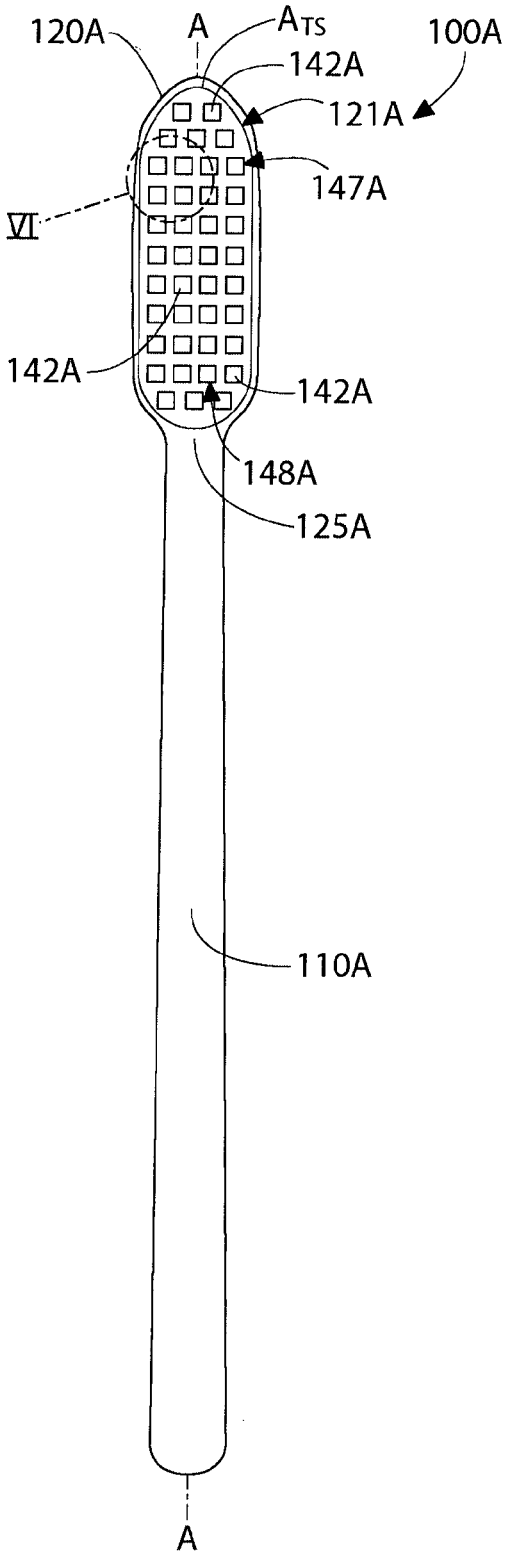
FIG. 5 is a front planar view of a toothbrush according another embodiment of the present invention.
Figure 6:
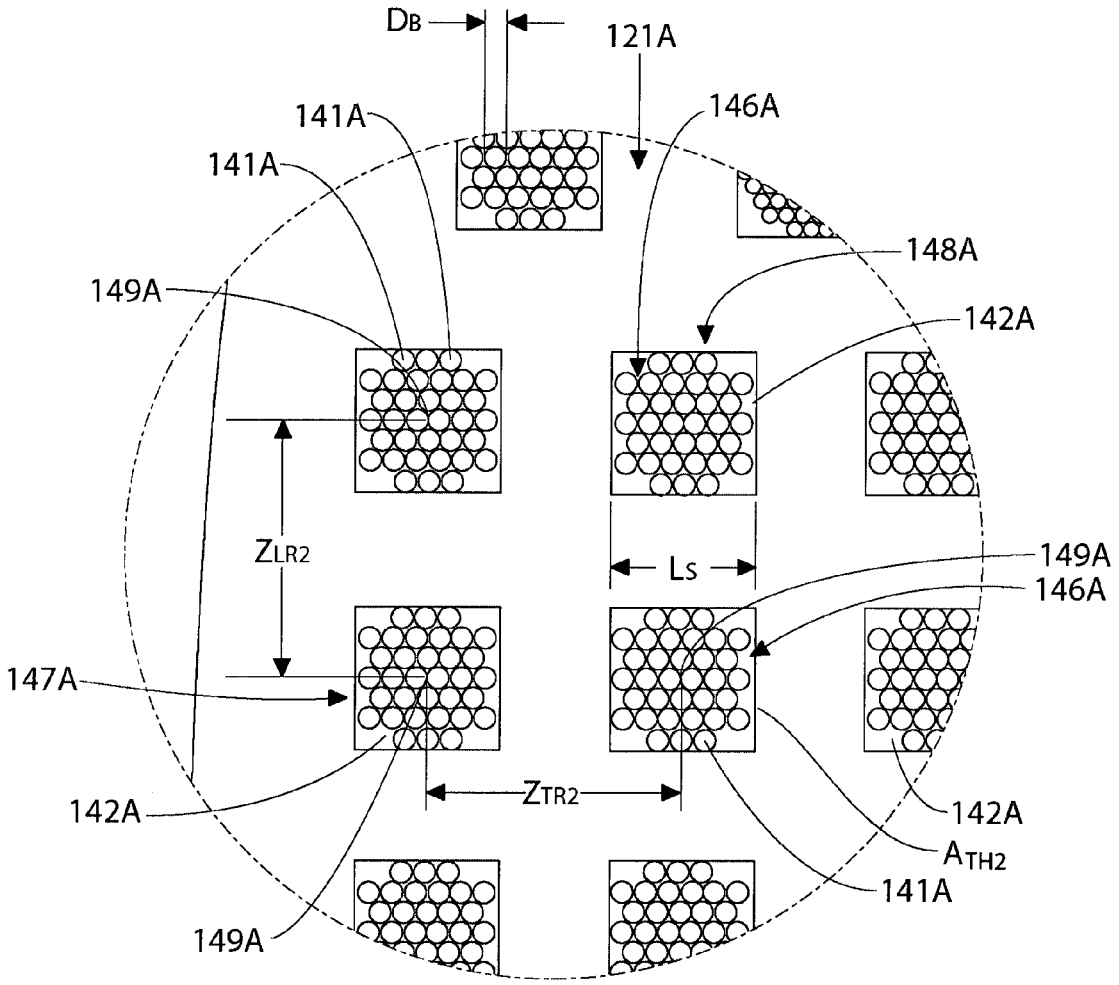
FIG. 6 is a close-up view of area VI of FIG. 5.

Referring now to FIGS. 5 and 6, a toothbrush 100A according to another embodiment of the invention is illustrated. The toothbrush 100A is identical to the toothbrush 100 in all respects except that the tuft holes 142A in the toothbrush 100A are rectangular, or square in shape rather than circular. Only those components of the toothbrush 100A that are different from the components of the toothbrush 100 will be described in detail below. The same reference numerals are used herein and in the drawings to designate similar components, except that for the toothbrush 100A there is an "A" at the end of each reference numeral.

The toothbrush 100A comprises a tufting area $A_{TS}$ having similar size requirements or preferences as the toothbrush 100. Thus, the tufting area $A_{TS}$ of the toothbrush 100A is in a range of 210 $mm^2$ to 270 $mm^2$. Moreover, in large head embodiments, the tufting area $A_{TS}$ is in a range of 230 $mm^2$ to 250 $mm^2$, with a size of approximately 242 $mm^2$ being most preferred. In small head embodiments, the tufting area $A_{TS}$ is in a range of 180 $mm^2$ to 210 $mm^2$, more preferably in a range of 190 $mm^2$ to 200 $mm^2$, with a size of approximately 195 $mm^2$ being most preferred.

Also similar to the toothbrush 100, the toothbrush 100A comprises X number of tuft holes 142A, wherein X is in a range of 32 to 40. More specifically, in an embodiment wherein the toothbrush 100A has a small head 120A, X is equal to approximately 32 and in an embodiment wherein the toothbrush 100A has a large head 120A, X is equal to approximately 40. As noted above, in the toothbrush 100A the tuft holes 142A are rectangular or square in shape having a side length $L_S$ in a range of 1.2 mm to 1.6 mm, and more specifically approximately 1.4 mm. Thus, the tuft holes 142A have a tuft hole area $A_{TH2}$ in a range of about 1.7 $mm^2$ to 2.2 $mm^2$, and more specifically approximately 1.96 $mm^2$.

A ratio of the tufting area $A_{TS}$ to the number of holes X is in a range of 5.2 to 6.4. In one preferred embodiment wherein the tuft holes 142 have a square or rectangular shape, the ratio of the tufting area $A_{TS}$ to the number of holes X is in a range of 5.9 to 6.2, and more particularly in a range of approximately 6.0 to 6.1.

Similar to the toothbrush 100, the tuft holes 142A in the toothbrush 100A are arranged on the first surface 121A of the head 120A in rows 147A, 148A. The rows 142A in the toothbrush 100A have the same configuration as the rows of tuft holes 142 in the toothbrush 100 except that the central section of tuft holes 142A are arranged on the front surface 121A of the head 120A in an 8×4 array. The remainder of the tuft holes 142A are arranged as discussed above with regard to the tuft holes 142 of the toothbrush 100. Of course, the invention is not to be limited by the particular arrangement of the tuft holes 142A illustrated and other arrangements of the tuft holes 142A on the front surface 121A of the head 120A are contemplated within the scope of the present invention.

Adjacent tuft holes 142A in each of the transverse rows 147A are separated by a distance ZTR2. More specifically, each of the tuft holes 142A has a center point 149A and ZTR2 is a linear distance between the center points 149A of adjacent tuft holes 142A in the transverse rows 147A. Furthermore, adjacent tuft holes 142A in each of the longitudinal rows 148A are separated by a distance ZLR2. More specifically, ZLR2 is a linear distance between the center portions 149A of adjacent tuft holes 142A in the longitudinal rows 148A. In certain embodiments, the distance ZLR2 between adjacent tuft holes 142A in each of the longitudinal rows are in a range of 2.1 mm to 2.3 mm, with 2.2 mm being preferred. Moreover, in certain embodiments the distance ZLR2 between adjacent tuft holes 142A is in a range of 2.3 mm to 2.7 mm, with 2.55 mm being preferred.

In embodiments where the tuft holes 142A are not circular in shape, the tuft holes 142A will generically comprise a perimeter P. According to certain embodiments of the present invention, the perimeter P is selected to be in a range of 5.0 mm to 6.0 mm, and more preferably in a range of 5.4 mm to 5.8 mm, and most preferably approximately 5.6 mm. In certain other embodiments of the invention, the sizes of the tuft holes 142A and the distances $Z_{TR2}$, $Z_{LR2}$ (collectively referred to as "Z") therebetween are controlled so that a ratio of Z to P is in a range of 0.35 to 0.46. In such embodiments, Z is preferably in a range of 2.1 to 2.7, and more preferably in a range of 2.2 mm to 2.6 mm. Of course, the embodiments having circular tuft holes 142 discussed above can have Z and P controlled such that the ratio of Z to P fits within the above-noted range.

In some embodiments, the tuft holes 142, 142A will be neither circular nor rectangular/square. For example, the tuft holes may be diamond-shaped, triangular or oval in certain embodiments.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the foregoing description and drawings represent the exemplary embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. A toothbrush comprising:

a handle;

a head having a first surface and a second surface, the first surface comprising a tufting area $A_{TS}$ in the range of 180 $mm^2$ to 270 $mm^2$ comprising X number of square tuft holes, wherein X is in the range of 32 to 44 the square tuft holes arranged in a pattern having a central section, a distal section, and a proximal section;

a bristle tuft mounted within and extending from each of the tuft holes, each of the bristle tufts formed by a plurality of tapered bristle filaments; wherein there are 28-40 filaments in each tuft hole wherein a ratio of $A_{TS}$ to X is in a range of 5.0 to 6.5 $mm^2$ per tuft hole;

wherein each of the tuft holes has a tuft hole area $A_{TH}$ and $X \times A_{TH}$ is in a range of 50 $mm^2$ to 80 $mm^2$;

wherein the square tuft holes of the central section of the pattern are arranged in a plurality of transverse rows that extend substantially perpendicular to a longitudinal axis of the toothbrush and a plurality of longitudinal rows that extend substantially parallel to the longitudinal axis of the toothbrush;

wherein the square tuft holes of the distal section of the pattern comprise a distal transverse row, the distal transverse row being transversely offset from the transverse rows of the central section;

wherein the square tuft holes of the proximal section of the pattern comprise a proximal transverse row, the proximal transverse row being transversely offset from the transverse rows of the central section; and wherein adjacent tuft holes of the transverse rows of the pattern are separated by a distance $Z_{TR2}$ and adjacent tuft holes of the plurality of longitudinal rows of the pattern are separated by a distance $Z_{LR2}$, the distance $Z_{TR2}$ being less than the distance $Z_{LR2}$.

2. The toothbrush according to claim 1 wherein the ratio of $A_{TS}$ to X is in a range of about 5.4 to 5.5.

3. The toothbrush according to claim 1 wherein the ratio of $A_{TS}$ to X is in a range of about 6.0 to 6.1.

4. The toothbrush according to claim 1, wherein the proximal transverse row is aligned with the distal transverse row.

5. The toothbrush according to claim 1, wherein the distance $Z_{TR2}$ is equal to 2.2 mm.

6. The toothbrush according to claim 5, wherein the distance $Z_{LR2}$ is equal to 2.55 mm.

7. A toothbrush comprising:

a handle;

a head having a first surface and a second surface, the first surface comprising a tufting area $A_{TS}$ in the range of 180 $mm^2$ to 270 $mm^2$ comprising X number of tuft holes, wherein X is in the range of 32 to 44 the tuft holes arranged in a pattern having a central section, a distal section, and a proximal section;

a bristle tuft mounted within and extending from each of the tuft holes, each of the bristle tufts formed by a plurality of tapered bristle filaments; wherein there are 28-40 filaments in each tuft hole wherein a ratio of $A_{TS}$ to X is in a range of 5.0 to 6.5 $mm^2$ per tuft hole;

wherein each of the tuft holes has a tuft hole area $A_{TH}$ and $XxA_{TH}$ is in the range of 50 $mm^2$ to 80 $mm^2$;

wherein the tuft holes of the central section of the pattern are arranged in a plurality of transverse rows that extend substantially perpendicular to a longitudinal axis of the toothbrush and a plurality of longitudinal rows that extend substantially parallel to the longitudinal axis of the toothbrush;

wherein the tuft holes of the distal section of the pattern comprise a first distal transverse row and a second distal transverse row, the first distal transverse row being transversely offset from the transverse rows of the central section, the second distal transverse row being aligned with the transverse rows of the central section, and the first distal row located between the second distal row and the central section along the longitudinal axis; and wherein the tuft holes of the proximal section of the pattern comprise a proximal transverse row, the proximal transverse row being transversely offset from the transverse rows of the central section.

* * * * *